US005252048A

United States Patent [19]

Fujiwara et al.

[11] Patent Number: 5,252,048

[45] Date of Patent: Oct. 12, 1993

[54] FLUID COMPRESSOR HAVING IMPROVED OLDHAM MECHANISM

[75] Inventors: Takayoshi Fujiwara, Kawasaki; Hisanori Honma; Yoshinori Sone, both of Yokohama, all of Japan

[73] Assignee: Kabushiki Kaisha Toshiba, Kawasaki, Japan

[21] Appl. No.: 903,133

[22] Filed: Jun. 23, 1992

[30] Foreign Application Priority Data

Jun. 25, 1991 [JP] Japan ..... 3-152107
Jun. 28, 1991 [JP] Japan ..... 3-183712

[51] Int. Cl.[5] ..... F01C 21/08

[52] U.S. Cl. ..... 418/220; 418/98; 417/356

[58] Field of Search ..... 418/220, 91, 97, 98; 417/355, 356; 464/102, 104

[56] References Cited

U.S. PATENT DOCUMENTS

| | | | |
|---|---|---|---|
| 1,171,347 | 2/1916 | Morse | 464/102 |
| 4,871,304 | 10/1989 | Iida et al. | 418/220 |
| 4,872,820 | 10/1989 | Iida et al. | 418/220 |
| 4,875,842 | 10/1989 | Iida et al. | 418/220 |
| 5,151,021 | 9/1992 | Fujiwara et al. | 417/356 |

FOREIGN PATENT DOCUMENTS

| | | | |
|---|---|---|---|
| 0345763 | 1/1937 | Italy | 418/98 |
| 1-76185 | 7/1990 | Japan | 418/220 |
| 0079814 | 4/1991 | Japan | 464/104 |
| 3-233182 | 6/1991 | Japan | 418/220 |

*Primary Examiner*—Richard A. Bertsch
*Assistant Examiner*—Charles G. Freay
*Attorney, Agent, or Firm*—Cushman, Darby & Cushman

[57] ABSTRACT

A fluid compressor includes a cylinder, a rotating member eccentrically arranged in the cylinder, the rotating member having a spiral groove formed in an outer surface thereof at a gradually decreasing pitch, a spiral blade having a suction-side end portion and a delivery-side end portion and fitted in the groove to be retractable, a plurality of operating chambers formed in the cylinder, partitioned by the blade, and gradually decreasing in volume, and allowing a target fluid to be supplied thereinto, an Oldham mechanism for coupling the cylinder and the rotating memory to each other and rotating the cylinder and the rotating member relative to each other, the Oldham mechanism having a rotating member Oldham portion arranged on the rotating member and having parallel slide contact surfaces, a lubricant supplied into the cylinder and urged against an inner surface of the cylinder upon rotation of the cylinder, and a lubricant retainer arranged in the cylinder and having a delivery hole for guiding the fluid, supplied into the cylinder, outside the cylinder, the lubricant retainer protruding into the cylinder to regulate a thickness of the lubricant, wherein a protrusion size h of the lubricant retainer into the cylinder is set to satisfy $$h > d/2 - (H/2 - e)$$

where d is an inner diameter of the cylinder, H is a distance between the slide contact surfaces of the rotating member Oldham portion, and e is an eccentricity of the rotating member.

12 Claims, 8 Drawing Sheets

FLUID COMPRESSOR HAVING IMPROVED OLDHAM MECHANISM

BACKGROUND OF THE INVENTION

1. Field of the Invention

The present invention relates to a fluid compressor and, more particularly, to a fluid compressor for compressing a refrigerant gas or the like used for a refrigeration cycle.

2. Description of the Related Art

For example, U.S. Pat. No. 4,871,304 discloses a fluid compressor designed to compress a fluid while transferring it.

As shown in FIG. 13, a compressor 1 of this type has a compression mechanism 3 and a motor 4 housed in a sealed case 2. In the compression mechanism 3, a rotating member 6 is eccentrically disposed in a cylinder 5, and the cylinder 5 and the rotating member 6 are supported by a main bearing 7. The main bearing 7 is fixed to the inner wall of the sealed case 2.

The two axial end portions of the cylinder 5 are respectively sealed by the main bearing 7 and a sub-bearing 8. A main shaft 9 and a sub-shaft 10 are respectively formed on the two axial end portions of the rotating member 6. The main shaft 9 and the sub-shaft 10 are respectively inserted into the bearings 7 and 8.

A spiral groove 11 is formed in the rotating member 6. The pitch of the groove 11 is gradually decreased as the groove 11 extends from one end to the other end. A spiral blade 12 is fitted in the groove 11 so that the space between the rotating member 6 and the cylinder 5 is partitioned into a plurality of regions by the blade 12. A plurality of operating chambers 13 are formed in the cylinder 5. The volumes of these operating chambers 13 are gradually decreased from one end to the other end, i.e., from the suction side to the delivery side of the cylinder 5.

The motor 4 is constituted by an annular stator 14 and an annular rotor 15. The stator 14 is fixed to the inner wall of the sealed case 2, whereas the rotor 15 is disposed inside the stator 14. In addition, the rotor 15 is fixed to the outside of the cylinder 5 so that the rotor 15 and the cylinder 5 are integrally rotated upon supplying a current to the motor 4. The rotational force of the cylinder 5 is transmitted to the rotating member 6 through an Oldham mechanism 16 (to be described later). As a result, the cylinder 5 and the rotating member 6 are relatively and synchronously rotated while their positional relationship is maintained.

Upon relative rotation of the cylinder 5 and the rotating member 6, the blade 12 protrudes/retracts from/into the groove 11 to protrude/retract in the radial direction of the rotating member 6. In addition, refrigerant gas in a refrigeration cycle is drawn into the cylinder 5 through a suction pipe 17 and a suction path 18. The suction pipe 17 is connected to the sealed case 2. The suction path 18 is formed in the main bearing 7.

The refrigerant gas drawn into the cylinder 5 is guided into a suction chamber 19, one of the operating chambers 13 which is located at a position nearest to the suction side. The refrigerant gas is further transferred to a delivery chamber 20, one of the operating chambers 13 which is located at the position nearest to the delivery side. Since the volumes of the operating chambers 13 are gradually decreased, the refrigerant gas is gradually compressed as it is transferred from the suction chamber 19 to the delivery chamber 20.

The compressed refrigerant gas is temporarily delivered into the internal space of the sealed case 2 through a delivery path 21 formed in the main bearing 7. A delivery pipe 22 is connected to the sealed case 2 so that the refrigerant gas in the sealed case 2 is transferred outside the compressor 1 through the delivery pipe 22.

The Oldham mechanism 16 has a rectangular rotating member Oldham portion 23. The rotating member Oldham portion 23 is formed between a rotating member body 24 and the sub-shaft 10. The Oldham mechanism 16 includes an Oldham pin 25 and an Oldham ring 26. The Oldham pin 25 protrudes inward from the cylinder 5 and is fixed to the cylinder 5. The Oldham ring 26 is slidably engaged with the Oldham pin 25 and the rotating member Oldham portion 23.

The Oldham pin 25 is rotated together with the cylinder 5. The rotating member Oldham portion 23 constitutes part of the rotating member 6 and is rotated together with the main shaft 9, the sub-shaft 10, and the rotating member body 24. The Oldham ring 26 is reciprocated in two orthogonal directions (X and Y directions) upon relative rotation of the cylinder 5 and the rotating member 6.

A sump 27 is formed in the sealed case 2. A lubricant 28 is reserved in the sump 27. Since the high-pressure refrigerant gas fills the sealed case 2, the pressure of the refrigerant gas acts on the lubricant 28. Part of the lubricant 28 is drawn into a lubricant path 29 formed in the sub-bearing 8. The lubricant 28 then flows into the cylinder 5 through a lubricant supply path (not shown) formed in the rotating member 6.

The lubricant 28 is supplied to sliding contact portions in the cylinder 5 (e.g., the portions between the rotating member 6 and the blade 12, the portions between the cylinder 5 and the blade 12, the portions between the cylinder 5 and the bearings 7 and 8, the portion between the main bearing 7 and the main shaft 9, the portion between the sub-bearing 8 and the sub-shaft 10, and the Oldham mechanism 16), thereby lubricating these sliding portions.

In the above-described fluid compressor 1, it is difficult to supply the lubricant to the Oldham mechanism 16. Therefore, a lubricant shortage tends to occur in the Oldham mechanism 16, and the respective parts are easily worn.

SUMMARY OF THE INVENTION

It is an object of the present invention to provide a fluid compressor which can improve the lubrication characteristics of an Oldham mechanism and reduce its wear by ensuring a sufficient amount of a lubricant supplied to the Oldham mechanism.

In order to achieve the above object, according to the present invention, there is provided a fluid compressor comprising:

a cylinder;

a rotating member eccentrically arranged in the cylinder, the rotating member having a spiral groove formed in an outer surface thereof at a gradually decreasing pitch;

a spiral blade having a suction-side end portion and a delivery-side end portion and fitted in the groove to be retractable;

a plurality of operating chambers formed in the cylinder, partitioned by the blade, and gradually decreasing in volume, and allowing a target fluid to be supplied thereinto;

an Oldham mechanism for coupling the cylinder and the rotating member to each other and rotating the cylinder and the rotating member relative to each other, the Oldham mechanism having a rotating member Oldham portion arranged on the rotating member and having parallel slide contact surfaces;

a lubricant supplied into the cylinder and urged against an inner surface of the cylinder upon rotation of the cylinder; and a lubricant retainer arranged in the cylinder and having a delivery hole for guiding the fluid, supplied into the cylinder, outside the cylinder, the lubricant retainer protruding into the cylinder to regulate a thickness of the lubricant, wherein a protrusion size h of the lubricant retainer into the cylinder is set to satisfy $$h > d/2 - (H/2 - e)$$

where d is an inner diameter of the cylinder, H is a distance between the slide contact surfaces of the rotating member Oldham portion, and e is an eccentricity of the rotating member.

DETAILED DESCRIPTION OF THE PREFERRED EMBODIMENTS

Embodiments of the present invention will be described below with reference to the accompanying drawings.

Figure 1:
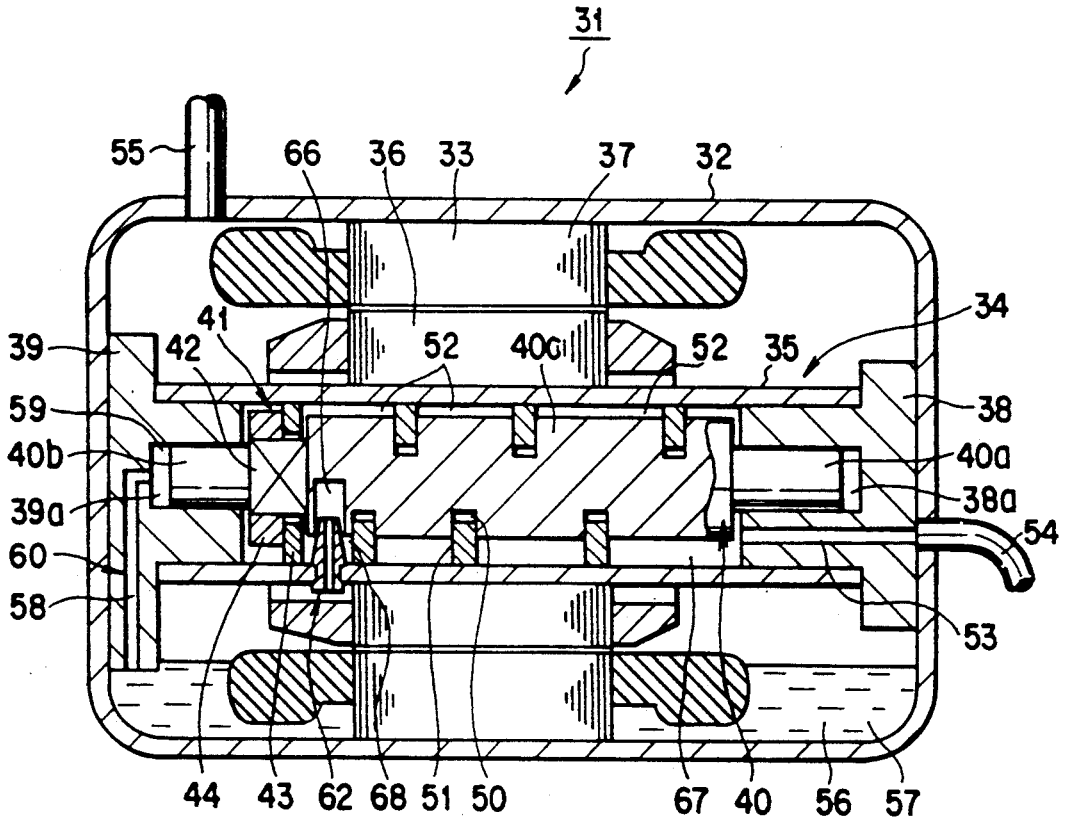
FIG. 1 is a sectional side view showing a fluid compressor according to the first embodiment of the present invention.

FIG. 1 shows a fluid compressor (to be referred to as a compressor hereinafter) 31 according to the first embodiment of the present invention. The compressor 31 is constituted by a sealed case 32, a motor element 33, and a compression element 34. The axial direction of the sealed case 32 is set horizontally. The two axial end portions of the sealed case 32 are sealed. The motor element 33 and the compression element 34 are housed in the sealed case 32.

The compression element 34 has a hollow cylinder 35. The motor element 34 is constituted by a stator 37 and a rotor 36. The rotor 36 is coaxially fitted on the outer surface of the cylinder 35. The stator 37 is fitted in the sealed case 32. The rotor 36 is disposed inside the stator 37.

One axial end portion of the cylinder 35 is open, in which a main bearing 38 is properly loose-fitted while the airtightness is maintained. The main bearing 38 is fixed to the inner surface of the sealed case 2. The other axial end portion of the cylinder 35 is also open, in which a sub-bearing 39 is properly loose-fitted while the airtightness is maintained.

That is, the two end portions of the cylinder 35 are respectively sealed by the main bearing 38 and the sub-bearing 39, and the cylinder 35 is rotatably supported by the bearings 38 and 39. A columnar rotating member 40 is housed in the cylinder 35. The axial direction of the rotating member 40 is parallel to the axial direction of the cylinder 35.

A central axis A of the rotating member 40 is shifted from a central axis B of the cylinder 35 by a distance e so that part of the outer surface of the rotating member 40 is in contact with the inner surface of the cylinder 35 along the axial direction. Referring to FIG. 1, since the cross-section does not cross the sliding contact portion between the cylinder 35 and the rotating member 40, the sliding contact portion is omitted.

A main shaft 40*a* and a sub-shaft 40*b* are respectively formed on the axial end portions of the rotating member 40. Each of the shafts 40*a* and 40*b* has a diameter smaller than that of a rotating member body 40*c*. The main bearing 38 has a pivot support hole 38*a*, in which the main shaft 40*a* of the rotating member 40 is inserted. Similarly, the sub-bearing 39 has a pivot support hole 39*a*, in which the sub-shaft 40*b* of the rotating member 40 is inserted. The rotating member 40 is rotatably supported by the two bearings 38 and 39.

Figure 2:
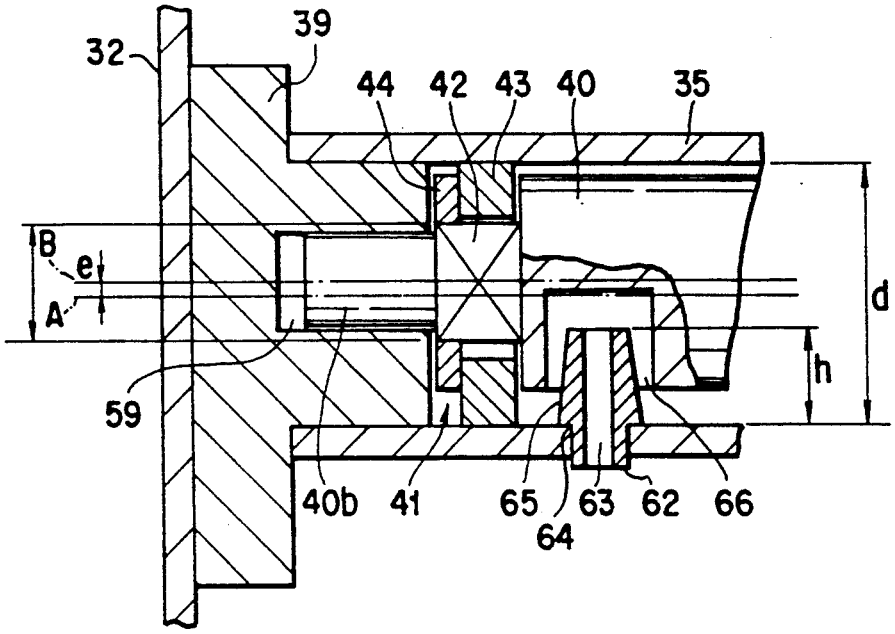
FIG. 2 is an enlarged view of a main part of the fluid compressor in FIG. 1.
Figure 3:
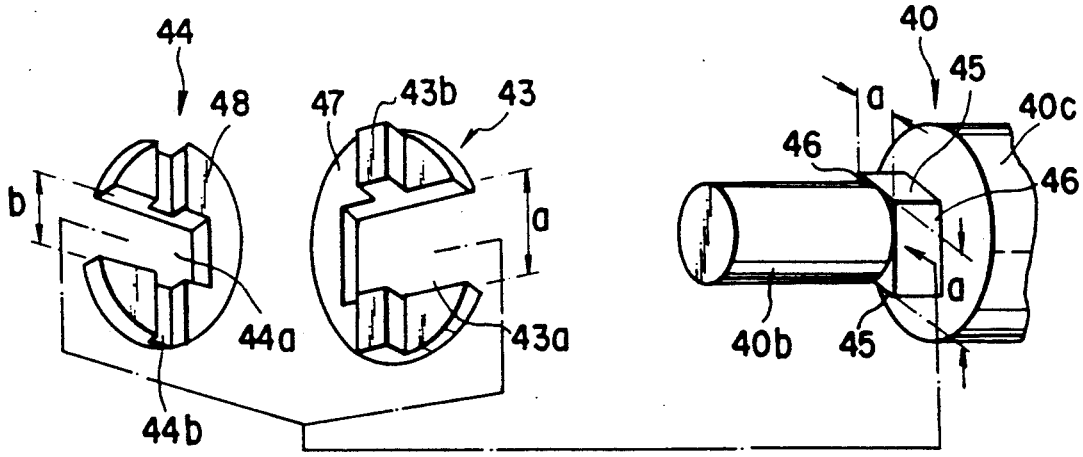
FIG. 3 is an exploded perspective view showing an Oldham mechanism.

As shown in FIGS. 1 to 3, an Oldham mechanism 41 is housed in the cylinder 35. The Oldham mechanism 41 is arranged on one end portion of the rotating member 40. The Oldham mechanism 41 is constituted by a rotating member Oldham portion 42, an Oldham ring receiver 43, and an Oldham ring 44. The rotating member Oldham portion 42 is formed to be continuous with the sub-shaft 40*b* and the rotating member body 40*c* of the rotating member 40 and is located between the sub-shaft 40*b* and the rotating member body 40*c*. The rotating member Oldham portion 42 constitutes part of the rotating member 40.

The rotating member Oldham portion 42 is processed to have a rectangular parallelepiped shape. Both the vertical and lateral dimensions of the rotating member Oldham portion 42 are set to be a value a. The parallelism between parallel surfaces 45 and that between parallel surfaces 46 of the rotating member Oldham portion 42 are accurately set.

Of the two pairs of parallel surfaces 45 and 46, one pair of parallel surfaces 45 will be referred to as slide contact surfaces hereinafter.

The Oldham ring receiver 43 has a disk-like shape and has an outer diameter almost equal to the inner diameter of the cylinder 35. A rectangular guide port 43a is formed in the center of the Oldham ring receiver 43. The guide port 43a is open to part of the circumferential surface of the Oldham ring receiver 43. The width (vertical dimension in FIG. 3) of the guide port 43a is set to be a value b. The value b is larger than the length a of one side of the rotating member Oldham portion 42.

Projections 43b are formed on one plate surface 47 of the Oldham ring receiver 43. Each projection 43b has a rectangular cross-section. The projections 43b extend along the radial direction of the Oldham ring receiver 43 to be formed astride the guide port 43a. A portion between the projections 43b is removed so that the projections 43b are located on both the sides of the guide port 43a in the direction of its width.

The Oldham ring 44 has a disk-like shape having a proper thickness. The diameter of the Oldham ring 44 is almost equal to the outer diameter of the rotating member body 40c. A rectangular engaging notched portion 44a is formed in the center of the Oldham ring 44. The engaging notched portion 44a is open to part of the circumferential surface of the Oldham ring 44. The open width (vertical dimension in FIG. 3) of the engaging notched portion 44a is set to be the value a.

Grooves 44b are formed in the other plate surface of the Oldham ring 44. The grooves 44b extend along the radial direction of the engaging notched portion 44a to be formed astride the engaging notched portion 44a. The grooves 44b are located on both the sides of the engaging notched portion 44a in the direction of its width.

The Oldham ring 44 and the Oldham ring receiver 43 are attached to the rotating member Oldham portion 42, and the rotating member Oldham portion 42 is inserted into the guide port 43a and the engaging notched portion 44a. The Oldham ring 44 and the Oldham ring receiver 43 are attached to the rotating member Oldham portion 42 through the guide port 43a and the engaging notched portion 44a.

The Oldham ring receiver 43 is fixed to the inner surface of the cylinder 35. In addition, the projections 43b of the Oldham ring receiver 43 are fitted in the grooves 44b of the Oldham ring 44. The Oldham ring 44 slides along the projections 43b (in the vertical direction in FIG. 3) while it is locked by the Oldham ring receiver 43.

A pair of parallel surfaces 49 are formed on the engaging notched portion 44a of the Oldham ring 44. Since the open width a of the engaging notched portion 44a is equal to the length of one side of the rotating member Oldham portion 42, the parallel surfaces 49 are brought into contact with the slide contact surfaces 45 of the rotating member Oldham portion 42. The Oldham ring 44 allows the rotating member Oldham portion 42 to move along the longitudinal direction (lateral direction in FIG. 3) of the engaging notched portion 44a. In this case, the parallel surfaces 49 reciprocate while sliding on the slide contact surfaces 45.

As shown in FIG. 1, the Oldham mechanism 41 serves to couple the cylinder 35 to the rotating member 40 and transmit the rotational force of the cylinder 35 to the rotating member 40 when the cylinder 35 is rotated. The cylinder 35 and the rotating member 40 are rotated relative to each other through the Oldham mechanism 41.

A spiral groove 50 is formed in the outer surface of the rotating member 40. The pitch of the groove 50 is gradually decreased as it extends from the main shaft 40a side to the sub-shaft 40b side of the rotating member 40.

A spiral blade 51 is fitted in the groove 50. The thickness of the blade 51 is set to be almost equal to the width of the groove 50. Each portion of the blade 51 protrudes/retracts in the radial direction of the rotating member 40 while sliding on the inner surface of the groove 50. In addition, the edge of the blade 51 slides on the inner surface of the cylinder 35 in tight contact therewith.

The space between the inner surface of the cylinder 35 and the outer surface of the rotating member 40 is partitioned into regions by the blade 51. A plurality of operating chambers 52 are formed in the cylinder 35. Since the pitch of the spiral groove 50 is gradually changed, the volumes of the operating chambers 52 are gradually decreased from the main shaft 40a side to the sub-shaft 40b side.

A suction hole 53 is formed in the main bearing 38. The suction hole 53 runs parallel to the pivot support hole 38a and extends through the main bearing 38 in the axial direction. A suction pipe 54 is connected to the sealed case 32, and one end portion of the suction hole 53 communicates with the suction pipe 54. The other end portion of the suction hole 53 is open in the cylinder 35.

A delivery pipe 55 is connected to the sealed case 32. The delivery pipe 55 is open in the sealed case 32. The delivery pipe 55 communicates with a component (not shown) of the refrigeration cycle.

A sump 56 is formed in the bottom portion of the sealed case 32. A lubricant 57 is injected into the sealed case 32 and is reserved in the sump 56. A lubricant path 58 is formed in the sub bearing 39. A portion of the sub-bearing 39 extends to a position below the surface and is dipped into the lubricant 57. The lubricant path 58 is open to this portion.

The lubricant path 58 has portions respectively extending in the radial and axial directions of the sub-bearing 39 and is bent midway between them. The lubricant path 58 communicates with a lubricant space 59 formed in a portion of the pivot support hole 38a.

A lubricant path (not shown) is also formed in the rotating member 40 to cause the lubricant space 59 to communicate with a predetermined portion of the spiral groove 50. A lubricant supply portion 60 is constituted by the lubricant paths in the sub-bearing 3 and the rotating member 40 and the lubricant space 59.

A lubricant retainer 62 is arranged in the cylinder 35. The lubricant retainer 62 is mounted in a lubricant retainer mounting hole 61. The lubricant retainer 62 is located near the Oldham mechanism 41. The lubricant retainer 62 has a cylindrical shape. A delivery hole 63 is coaxially formed in the lubricant retainer 62. As shown in FIG. 2, the lubricant retainer 62 has a stepped portion 64 on its outer surface and is locked to the inner surface of the cylinder 35 by using this stepped portion 64. A protruding portion 65 of the lubricant retainer 62 protrudes into the cylinder 35.

The outer surface of the lubricant retainer 62 is tapered toward its distal end. In addition, the stepped portion 64 of the lubricant retainer 62 is set to be large enough to reliably fix the lubricant retainer 62 and prevent it from being loosened.

A lubricant retainer receiving recess portion 66 is formed in the outer surface of the rotating member 40. The recess portion 66 is opened in the form of a circle. The diameter of the recess portion 66 is set to be larger than the outer diameter of the lubricant retainer 62. The recess portion 66 opposes the lubricant retainer 62. The recess portion 66 receives the lubricant retainer 62 to prevent it from coming into contact with the rotating member 40.

In addition, the height of the protruding portion 65, i.e., a protrusion size h of the lubricant retainer 62, is determined to satisfy the following inequality:

$$h > d/2 - (H/2 - e)$$

where d is the inner diameter of the cylinder 35, H is the distance between the slide contact surfaces 45 of the rotating member Oldham portion 42 (the length a of one side of the rotating member Oldham portion 42), and e is the eccentricity of the central axis A of the rotating member with respect to the central axis B of the cylinder.

Referring to FIG. 2, the illustration of the lubricant path 58 is omitted.

An operation of the compressor 31 will be described next.

When a current is supplied to the motor element 33, the cylinder 35 is rotated. The rotational force of the cylinder 35 is transmitted to the rotating member 40 through the Oldham mechanism 41. As a result, the rotating member 40 is rotated while part of its outer surface is brought into contact with the inner surface of the cylinder 35. Upon rotation of the rotating member 40, the blade 51 is rotated together with the rotating member 40.

The blade 51 is rotated while its outer surface is brought into contact with the inner surface of the cylinder 35. Consequently, as the outer surface of the rotating member 40 and the inner surface of the cylinder 35 approach the sliding contact portions the blade 51 is retracted into the groove 50. In contrast to this, as the outer surface of the rotating member 40 and the inner surface of the cylinder 35 are separated from the sliding contact portions, the blade 51 protrudes from the groove 50.

Upon relative rotation of the cylinder 35 and the rotating member 40, the refrigerant gas in the refrigeration cycle is drawn into the suction hole 53 through the suction pipe 54. The refrigerant gas flows into the cylinder 35 through the suction hole 53. The refrigerant gas is then sequentially transferred from the operating chamber located at the end of the suction side (i.e., a suction chamber 67) to the operating chamber located at the end of the delivery side (i.e., a delivery chamber 68) while it is confined in the operating chambers 52. Since the volumes of the operating chambers 52 are gradually decreased, the refrigerant gas is compressed while it is transferred.

The refrigerant gas compressed to attain a predetermined pressure is delivered into the internal space of the sealed case 32 through the delivery hole 63 of the lubricant retainer 62. The refrigerant gas then fills the sealed case 32, and the high-pressure refrigerant gas is guided into an external refrigeration cycle unit through the delivery pipe 55.

When the sealed case 32 is filed with the high-pressure refrigerant gas, the pressure of the refrigerant gas acts on the surface of the lubricant 57 so that part of the lubricant 57 is drawn into the lubricant path 58 of the sub-bearing 39. The lubricant 57 then flows into the lubricant supply portion 60 while it receives a centrifugal force generated upon rotation of the rotating member 40. Subsequently, the lubricant 57 flows into the spiral groove 50 through the lubricant space 59 and the lubricant path 58 in the rotating member 40.

The lubricant 57 is supplied to the respective siding contact portions in the cylinder 35 to lubricate them. For example, the sliding contact portions include the portions between the rotating member 40 and the blade 51, the portions between the blade 51 and the cylinder 35, the portion between the cylinder 35 and the main bearing 38, the portion between the cylinder 35 and the sub-bearing 39, the portions between the two shafts 40*a* and 40*b* of the rotating member 40 and the two bearings 38 and 39, and the Oldham mechanism 41.

The lubricant 57 guided into the cylinder 35 by the centrifugal force generated upon relative rotation of the cylinder 35 and the rotating member 40 is urged against the inner surface of the cylinder 35. The lubricant 57 is then delivered outside the cylinder 35 together with the compressed refrigerant gas through the delivery hole 63 of the lubricant retainer 62.

However, as shown in FIG. 2, since the lubricant retainer 62 protrudes into the cylinder 35, the lubricant 57 is retained on the delivery side of the cylinder 35 by an amount corresponding to the protrusion size h of the lubricant retainer 62. When the lubricant 57 reaches the distal end of the protruding portion 65, and the thickness (or depth) of the lubricant 57 exceeds the protrusion amount of the lubricant retainer 62, only a portion of the lubricant which flows over the protruding portion 65 is guided outside the cylinder 35 through the delivery hole 63.

That is, in the above-described compressor 31, since the lubricant retainer 62 is arranged in the cylinder 35 to protrude thereinto, the lubricant 57 in the cylinder 35 is blocked by the lubricant retainer 62. This structure prevents the lubricant 57 from being immediately delivered, and allows it to be retained in the cylinder 35. Therefore, a sufficient amount of the lubricant 57 can be ensured in the cylinder 35.

In addition, since the protrusion size of the lubricant retainer 62 (the height of the protruding portion 65) h is set to be larger than $d/2 - (H/2 - e)$, a sufficient amount of the lubricant 57 can always be ensured in the cylinder 35. That is, the thickness of the lubricant 57 is controlled by the protrusion size h of the lubricant retainer 62 so that one of the slide contact surfaces 45 of the rotating member Oldham portion 42 is always dipped in the lubricant 57. The lubricant 57 is guided to the respective components of the Oldham mechanism 41 upon rotation of the rotating member Oldham portion 42.

Therefore, the lubricant 57 is incessantly supplied to the Oldham mechanism 41 to sufficiently cool and lubricate it. Lubricant films are reliably formed on the sliding contact portions of the Oldham mechanism 41 to prevent wear.

Figure 4:
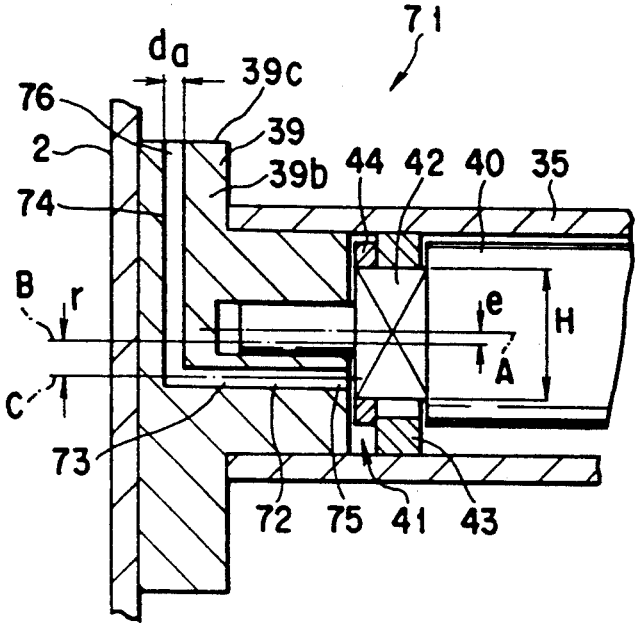
FIG. 4 is a sectional side view showing a main part of the second embodiment of the present invention.

A fluid compressor according to the second embodiment of the present invention will be described below with reference to FIG. 4. Note that FIG. 4 shows only a main part of a compressor 71. The same reference numerals in FIG. 4 denote the same parts as in FIG. 1, and a description thereof will be omitted.

The lubricant retainer 62 in the first embodiment is not required for the compressor 71. A delivery hole 72 as a delivery path is formed in a sub-bearing 39 as a bearing member. The delivery hole 72 has a round cross-section. The diameter of the delivery hole 72 is set to be almost the same through its length. Referring to FIG. 4, the diameter is represented by $\phi d_a$.

In this case, the diameter $\phi d_a$ of the delivery hole 72 can be set to be almost equal to that of the delivery hole 63 of the lubricant retainer 6 described above.

The delivery hole 72 extends parallel to axes A and B of a rotating member 40 and a cylinder 35. One end portion of the delivery hole 72 is open to an end face of the sub-bearing 39. In addition, the delivery hole 72 is bent at almost a right angle at its intermediate portion. The other end of the delivery hole 72 is open to an outer surface 39*c* of a flange portion 39*b* of the sub-bearing 39. That is, the delivery hole 72 has a portion 73 parallel to the two axes A and B and a portion 74 extending in the radial direction of the flange portion 39*b*.

The position of the portion 73 extending in the axial direction has correlation with the position of the axis B of the cylinder 35. More specifically, the position of the portion 73 extending in the axial direction is determined with reference to the axis B of the cylinder 35, and a central axis C of the portion 73 is separated from the axis B of the cylinder 35. The distance between the axes B and C is represented by reference symbol r.

Furthermore, the position of an inlet 75 of the delivery hole 72 is determined to satisfy the following inequality:

$$r - da/2 < H/2 - e$$

where $d_a$ is the diameter of the delivery hole 72, H is the distance between slide contact surfaces 45 of a rotating member Oldham portion 42 (a length a of one side of the rotating member Oldham portion 42), and e is the eccentricity of the central axis A of the rotating member 40 with respect to the central axis B of the cylinder 35.

The inlet 75 of the delivery hole 72 is located between the axis B of the cylinder 35 and one of the slide contact surfaces 45 of the rotating member Oldham portion 42.

Note that an Oldham mechanism 41 has the same arrangement as that of the one in the first embodiment (but may have different dimensions).

In the above-described compressor 71, the refrigerant gas compressed in the cylinder 35 flows through the delivery hole 72 and is delivered outside the cylinder 35 from an outlet 76 of the delivery hole 72. A lubricant (not shown) is supplied into the cylinder 35. The lubricant in the cylinder 35 is delivered together with the refrigerant gas through the delivery hole 72. In this case, the lubricant can be supplied by using various types of known means.

Since the position of the opening of the delivery hole 72 is set to satisfy $r - d_a/2 < H/2 - e$, one of the slide contact surfaces 45 of the rotating member Oldham portion 42 is always located below the lubricant surface. Therefore, the lubricant is incessantly supplied to the entire Oldham mechanism 41 upon rotation of the rotating member Oldham portion 42 so that the Oldham mechanism 41 can be sufficiently cooled and lubricated. Lubricant films are reliably formed on the sliding contact portions of the Oldham mechanism 41 to prevent wear.

FIGS. 5 to 8 show an Oldham mechanism 81 arranged in a fluid compressor according to the third embodiment of the present invention. This Oldham mechanism 81 is constituted by an Oldham ring receiver 82, an Oldham ring 83, and a rotating member Oldham portion 84. Of these components, the rotating member Oldham portion 84 is formed to be continuous with a sub-bearing 85*b* and a rotating member body 85*c* of a rotating member 85 and located therebetween. The rotating member Oldham portion 84 constitutes part of the rotating member 85.

The Oldham ring receiver 82 has a round annular shape. The outer diameter of the Oldham ring receiver 82 is almost equal to the inner diameter of the cylinder 35. The Oldham ring receiver 82 is fixed to the cylinder 35 through screws and the like (not shown) to be rotated together with the cylinder 35. Projections 87 are formed on one plate surface 86 of the Oldham ring receiver 82. The projections 87 are separated from each other by 180x and extend throughout the width of the Oldham ring receiver 82.

Figure 5:
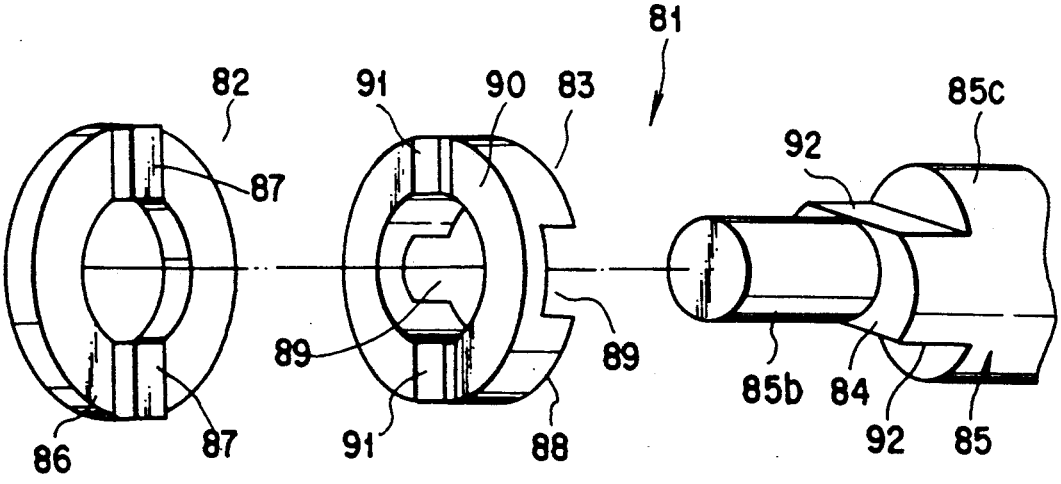
FIG. 5 is an exploded perspective view showing the Oldham mechanism of a fluid compressor according to the third embodiment of the present invention.
Figure 6:
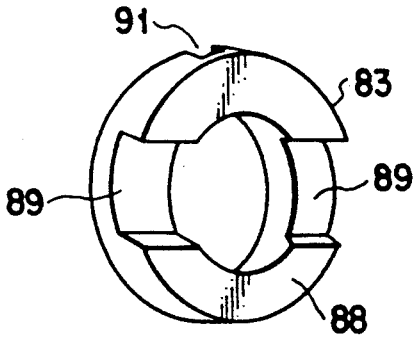
FIG. 6 is a perspective view showing an Oldham ring according to the third embodiment of the present invention.
Figure 7:
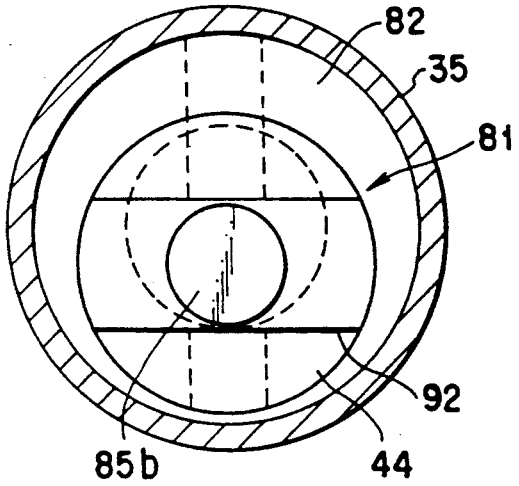
FIG. 7 is a front view showing the Oldham mechanism according to the third embodiment.
Figure 8:
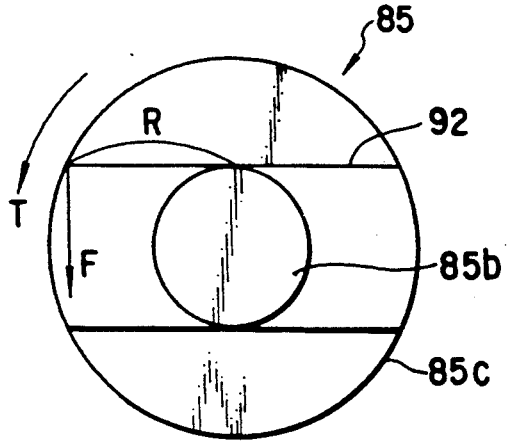
FIG. 8 is a view for explaining the function of the Oldham mechanism according to the third embodiment.

As shown in FIGS. 5 and 6, first engaging grooves 89 are formed in one plate surface 88 of the Oldham ring 83. The first engaging grooves 89 extend throughout the width of the Oldham ring 83. The projections 87 of the Oldham ring receiver 82 are fitted in the first engaging grooves 89 so that the Oldham ring 83 slides on the Oldham ring receiver 82. The inner diameter of the Oldham ring 83 is set to be larger than the diameter of the sub-bearing 85*b* so that the Oldham ring 83 does not interfere with the sub-bearing 85*b* of the rotating member 85. In addition, the outer diameter of the Oldham ring 83 is set to be almost equal to the outer diameter of the rotating member 85.

Second engaging grooves 91 are formed in the other plate surface 90 of the Oldham ring 83. These second engaging grooves 91 extend in a direction perpendicular to the first engaging grooves 89. The rotating member Oldham portion 84 is fitted in the second engaging grooves 91 so that the rotating member Oldham portion 84 slides on the Oldham ring 83.

The rotating member Oldham portion 84 has a pair of parallel slide contact surfaces 92. The distance between the slide contact surface 92 is set to be almost equal to or slightly larger than the diameter of the sub-bearing 85*b*. For example, these slide contact surfaces 92 are formed by beveling the rotating member 85. The rotating member Oldham portion 84 extends throughout the length of the rotating member in the radial direction.

In the fluid compressor including the Oldham mechanism 81 having the above-described structure, the rotational force of the cylinder 35 is transmitted to the rotating member 85 through the Oldham mechanism 81.

Especially, since the rotating member Oldham portion 84 has the parallel slide contact surfaces 92 and extends throughout the length of the rotating member 85 in the radial direction, a radius R of a torque T is large. Therefore, a surface pressure F acting on the rotating member Oldham portion 84 is small, and wear does not easily occur.

When the cylinder 35 and the rotating member 85 are rotated, the lubricant supplied into the cylinder 35 is urged against the inner surface of the cylinder 35 by the centrifugal force. Since the outer surface of the rotating member 85 is in contact with the inner surface of the cylinder 35, and the rotating member Oldham portion 84 extends throughout the length of the rotating member 85 in the radial direction, at least part of the slide contact surfaces 92 is always dipped in the lubricant. Therefore, the lubricant in the cylinder 35 is incessantly supplied to the slide contact surfaces 92 so that the lubricant can be reliably supplied to the Oldham mechanism 81, and a long lubrication time can be ensured.

The Oldham ring 83 is moved along the projections 87 of the Oldham ring receiver 82 to approach the inner surface of the cylinder 35. Consequently, the lubricant can be easily supplied between the first engaging grooves 89 of the Oldham ring 83 and the projections 87 of the Oldham ring receiver 82.

For the above-described reasons, a sufficient amount of the lubricant is incessantly supplied to the Oldham mechanism 81, and wear is reduced over a long period of use of the compressor.

The fourth embodiment of the present invention will be described next with reference to FIG. 9.

Figure 9:
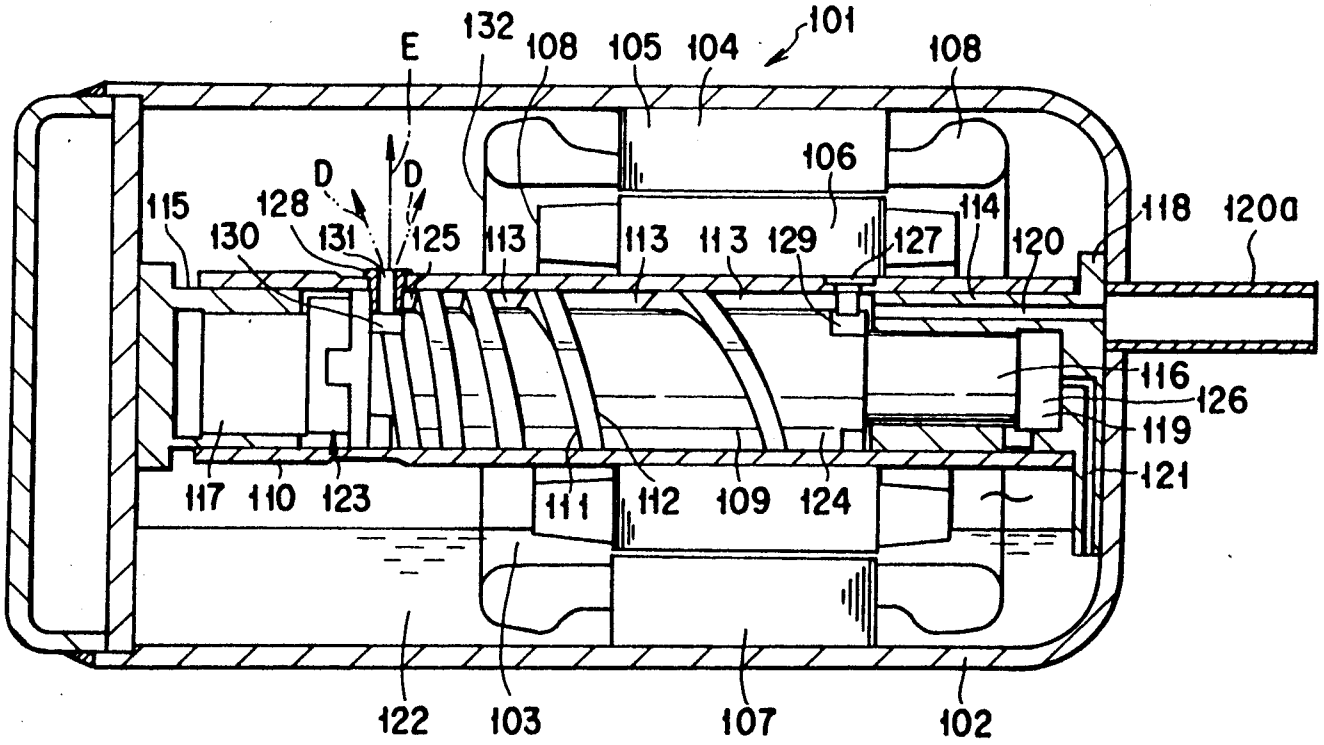
FIG. 9 is a sectional side view showing a fluid compressor according to the fourth embodiment of the present invention.

FIG. 9 shows the fourth embodiment of the present invention. Referring to FIG. 9, reference numeral 101 denotes a fluid compressor (to be referred as a compressor hereinafter).

The compressor 101 has a compression mechanism 103 and a motor 104 housed in a sealed case 102. Of these components, the motor 104 is constituted by an annular stator 105 and an annular rotor 106. The stator 105 includes a core 107 and a winding 108. The stator 105 is fixed to the inner wall of the sealed case 102. The rotor 106 is disposed inside the stator 105.

In the compression mechanism 103, a rotating member 109 is eccentrically arranged in a cylinder 110 such that part of the outer surface of the rotating member 109 is in contact with the inner surface of the cylinder 110. A spiral groove 111 is formed in the outer surface of rotating member 109. The pitch of the groove 111 is gradually decreased from one end side to the other end side of the groove 111. A spiral blade 112 is fitted in the groove 111.

The edge of the blade 112 is in contact with the inner surface of the cylinder 110 so that the space between the cylinder 110 and the rotating member 109 is partitioned into a plurality of regions. Operating chambers 113 are formed in the cylinder 110. The volumes of these operating chambers 113 are gradually decreased from one end side to the other end side, i.e., from the suction side to the delivery side of the cylinder 110.

A main bearing 114 and a sub-bearing 115 are respectively inserted in the two axial end portions of the cylinder 110. In addition, a main shaft 116 and a sub-shaft 117 are respectively inserted into the main bearing 114 and the sub-bearing 115. The main bearing 114 is fixed to the inner wall of the sealed case 102. The cylinder 110 and the rotating member 109 are supported by the main bearing 114.

A flange portion 118 is formed on the main bearing 114. The flange portion 118 is exposed outside the cylinder 110. Furthermore, a bore 119, a suction path 120, and a lubricant path 121 are formed in the main bearing 114. The main shaft 116 of the rotating member 109 is inserted in the bore 119. The suction path 120 is located outside the bore 119 and extends almost parallel to the axial direction of the main bearing 114.

The lubricant path 121 has an L shape. That is, the lubricant path 121 has a portion extending along the axis of the main bearing 114 and a portion extending in the radial direction of the main bearing 114. The lubricant path 121 is open to the bottom of the bore 119 and the circumferential surface of the flange portion 118 to cause the bore 119 to communicate with the outside of the main bearing 114. A portion of the flange portion 118 is located below the liquid surface of a lubricant 122 reserved in the sealed case 102. Part of the lubricant 122 flows into the lubricant path 121.

The rotor 106 of the motor 104 is fixed to the outer surface of the cylinder 110 at an intermediate position thereof in the radial direction. When a current is supplied to the motor 104, the rotor 106 and the cylinder 110 are integrally rotated. The rotational force of the cylinder 110 is transmitted to the rotating member 109 through an Oldham mechanism 123 arranged on the delivery side (the left side in FIG. 9) of the cylinder 110. As a result, the cylinder 110 and the rotating member 109 are relatively and synchronously rotated.

Upon relative rotation of the cylinder 110 and the rotating member 109, the blade 112 protrudes/retracts from/into the groove 111 to protrude/retract in the radial direction of the rotating member 109. In addition, a refrigerant as a fluid to be compressed is drawn into the cylinder 110 through a suction pipe **120*a* connected to the sealed case 102 and the suction path 120 formed in the main bearing 114. The refrigerant drawn into the cylinder 110 is supplied into a suction chamber 124, one of the operating chambers 113 which is located at the end of the suction side. The refrigerant is gradually compressed while it is transferred from the suction chamber 124 to a delivery chamber 125**.

In this embodiment, as the Oldham mechanism 123, for example, the Oldham mechanism 41 or 81 in the first or second embodiment of the present invention can be used.

Along with the compressing operation performed by the compression mechanism 103, the lubricant 122 reserved in the sealed case 102 is drawn into the lubricant path 121. The lubricant 122 is then supplied into the cylinder 110 through the bore 119 in the main bearing 114 and a lubricant space 126 between the main bearing 114 and the main shaft 116. The lubricant 122 supplied into the cylinder 110 is transferred to the delivery side of the cylinder 110 while it is mixed with, e.g., the refrigerant.

In addition, the compressor 101 has two blade stoppers 127 and 128 respectively arranged on the suction and delivery sides. The suction-side blade stopper 127 is constituted by a solid columnar member having a stepped portion on its surface. The delivery-side blade stopper 128 is constituted by a hollow cylindrical member having a stepped portion on its outer surface, similar to the suction-side blade stopper 127.

The blade stoppers 127 and 128 are inserted into the cylinder 110 from the outside. The axes of the blade stoppers 127 and 128 are set in the radial direction of the cylinder 110. The blade stoppers 127 and 128 are respectively engaged with the cylinder 110 by using the stepped portions on the surfaces.

The suction-side blade stopper 127 is located on the suction side of the cylinder 110, i.e., the right side in FIG. 9, so as to extend into the suction chamber 124. In addition, the suction-side blade stopper 127 is located near the suction side end portion of the blade 112 and extends into a suction side recess portion 129 in the rotating member 109. The suction-side blade stopper 127 is located inside the rotor 106 in the radial direction and is covered with the rotor 106. Furthermore, the suction-side blade stopper 127 is urged against the cylinder 110 by the rotor 106.

The delivery-side blade stopper 128 is arranged on the delivery side, i.e., the left side of the cylinder 110 in FIG. 9, so as to extend into the delivery chamber 125. In addition, the delivery-side blade stopper 128 is located near the delivery-side end portion of the blade 112 and extends into a delivery-side recess portion 130 in the rotating member 109. The delivery-side blade stopper 128 is located outside the rotor 106 in the radial direction and is separated from the rotor 106. The delivery-side blade stopper 128 causes the delivery chamber 125 to communicate with the outside of the cylinder 110 through a delivery hole 131 as a path for a fluid to be compressed.

The flange portion of the delivery-side blade stopper 128 is exposed outside the cylinder 110 and is locked in the cylinder 110.

When the blade 112 is about to move to the suction or delivery side along the groove 111, a corresponding one of the blade stoppers 127 and 128 comes into contact with an end portion of the blade 112 to stop the blade 112, thus inhibiting the movement of the blade 112.

The compressed high pressure refrigerant is delivered outside the cylinder 110 through the delivery hole 131 of the suction-side blade stopper 128, as indicated by arrows D of alternate long and short dashed lines in FIG. 9.

The lubricant which has reached the delivery chamber 125 flows outside the cylinder 110 together with the refrigerant through the delivery hole 131. The lubricant is then separated from the refrigerant by the centrifugal force generated upon rotation of the cylinder 110 so as to be discharged in the centrifugal direction of the cylinder 110, as indicated by an arrow E of an alternate long and short dashed line in FIG. 9. The lubricant flows outside the cylinder 110 from a position spaced apart from the motor 104 and comes into contact with the inner wall of the sealed case 102 without making contact with a coil end 132 of the rotor 106 halfway. The sealed case 102 is then cooled by the lubricant, and the temperature of the sealed case 102 is decreased.

That is, in the compressor 101 having such a structure, since the suction-side blade stopper 127 is located inside the rotor 106 and is covered therewith, the sealing properties of the suction chamber 124 and the cylinder 110 can be improved. Therefore, a gas leak around the suction-side bade stopper 127 can be prevented.

In addition, since the suction-side blade stopper 127 is urged against the cylinder 110 by the rotor 106, the suction-side blade stopper 127 can be reliably fixed to the cylinder 110.

Furthermore, since the delivery-side blade stopper 128 is located outside the rotor 106 and is spaced apart from the motor 104, the lubricant flowing from the delivery hole 131 can be brought into contact with the sealed case 102 without being blocked by the coil end 132 of the rotor 106. Therefore, the cooling efficiency of the sealed case 102 can be improved.

Moreover, since the lubricant 122 reserved in the sealed case 102 is directly guided to the lubricant path 121 formed in the main bearing 114, no lubricant pipe for guiding a lubricant is required. Therefore, assembly of the compressor 101 is facilitated, and the number of components is reduced.

Figure 10:
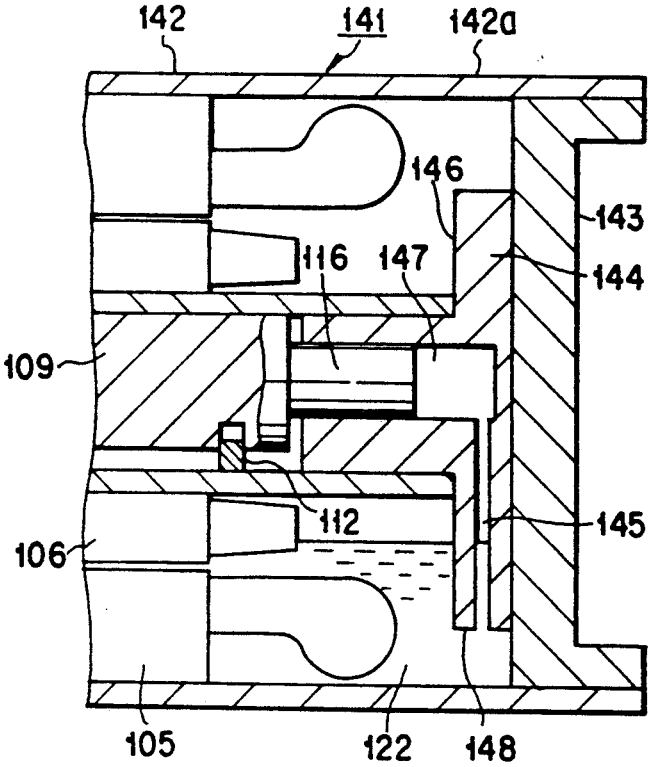
FIG. 10 is a sectional side view showing a main part of the fifth embodiment of the present invention.

FIG. 10 shows a main part of a fluid compressor 141 according to the fifth embodiment of the present invention.

Referring to FIG. 10, one axial end portion of a sealed case 142 is open, and an opening portion of a case body **142*a* is sealed by a frame 143. A main bearing 144 as a bearing member is attached to the frame 143. A lubricant path 145 is formed in the main bearing 144. The lubricant path 145 extends in a flange portion 146 in the radial direction. The lubricant path 145 is open to the inner surface of a bore 147 in the main bearing 144 and the circumferential surface of the flange portion 146**.

In this compressor 141, a lubricant 122 is directly guided into the lubricant path 145 and is supplied into a cylinder 110.

That is, the compressor 141 requires no lubricant pipe and no components for providing a seal between the lubricant pipe and the main bearing 144. Therefore, the number of components and the cost of the compressor can be reduced. In addition, since a space for mounting a lubricant pipe need not be set in the main bearing 144, the axial dimension of the main bearing 144 can be reduced.

Figure 11:
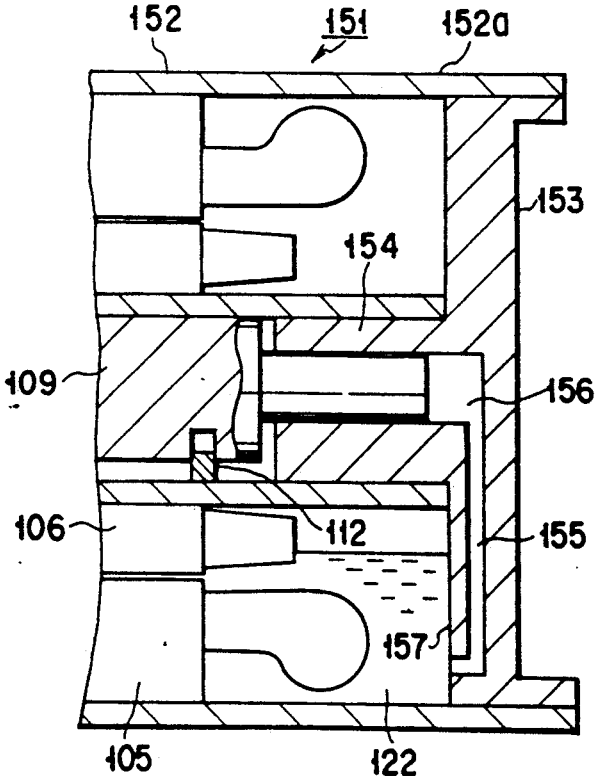
FIG. 11 is a sectional side view showing a main part of the sixth embodiment of the present invention.

FIG. 11 shows a main part of a fluid compressor 151 according to the sixth embodiment of the present invention.

Referring to FIG. 11, a case body **152*a* of a sealed case 152 is sealed by a frame 153, and a main bearing 154 as a bearing member is integrally formed in the frame 153. An L-shaped lubricant path 155 is formed in the frame 153. This lubricant path 155 is open to the inner surface of a bore 156 in the main bearing 154 and a flat inner wall 157 of the frame 153**.

Similar to the fourth embodiment, in this compressor 151, a lubricant 122 is directly guided into the lubricant path 155 and is supplied into a cylinder 110.

The seventh embodiment of the present invention will be described below with reference to FIG. 12. The same reference numerals in the seventh embodiment denote the same parts as in the fourth embodiment, and a description thereof will be omitted.

Figure 12:
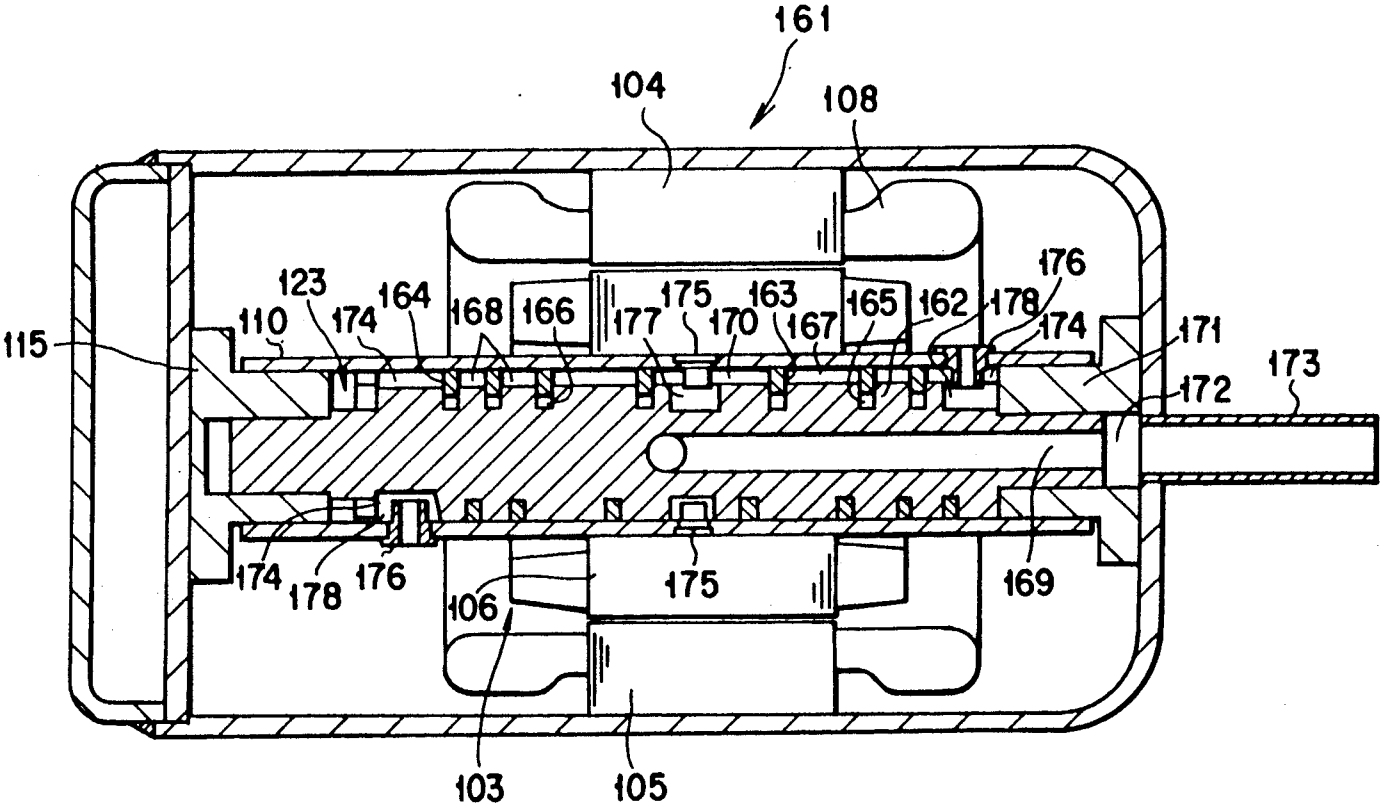
FIG. 12 is a sectional side view showing a fluid compressor according to the seventh embodiment of the present invention.
Figure 13:
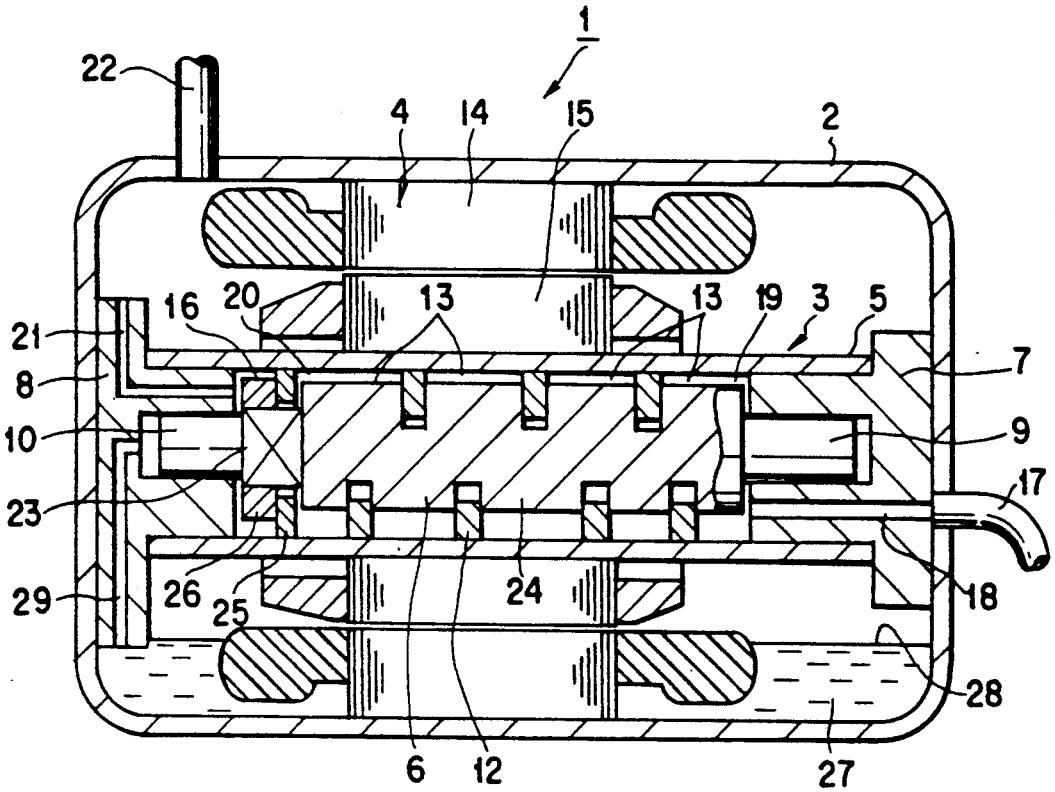
PRIOR ART F I G. 13
FIG. 13 is a sectional side view showing a conventional fluid compressor.

FIG. 12 shows the seventh embodiment of the present invention. Referring to FIG. 12, reference numeral 161 denotes a fluid compressor (to be referred to as a compressor hereinafter). In this compressor 161, two spiral blades 163 and 164 indicated by alternate long and two short dashes lines are mounted on a rotating member 162. Spiral grooves 165 and 166 are formed in the rotating member 162. The pitch of each of the grooves 165 and 166 is gradually changed. The blades 163 and 164 are respectively fitted in the grooves 165 and 166. The blades 163 and 164 respectively extend from an intermediate portion to the end portions of the rotating member 162 in the axial direction.

The pitches of the blades 163 and 164 are gradually decreased as they respectively extend from an intermediate portion to the end portions of the rotating member 162. In addition, the edges of the blades 163 and 164 are in contact with the inner surface of a cylinder 110. The space between the cylinder 110 and the rotating member 162 is partitioned into a plurality of regions by the blades 163 and 164. Two combinations of operating chambers 167 and 168 are formed in the cylinder 110. The volumes of the respective combinations of the chambers 167 and 168 are gradually decreased from an intermediate portion to the respective end portions of the cylinder 110 in the axial direction.

A suction-gas supply path 169 is formed in the rotating member 162. The suction gas supply path 169 has a portion extending along the axis of the rotating member 162 and a portion extending along the radial direction thereof and is open to one end face and outer surface of the rotating member 162. The suction gas supply path 169 causes a suction chamber 170 located at an intermediate portion of the cylinder 110 in the axial direction to communicate with a bore 172 in a main bearing 171.

A rotor 106 of a motor 104 is mounted on an intermediate portion of the cylinder 110 in the axial direction. When a current is supplied to the motor 104, the rotor 106 and the cylinder 110 are integrally rotated. The rotational force of the cylinder 11 is transmitted to the rotating member 162 through an Oldham mechanism 123 arranged on one end side of the cylinder 110. As a result, the cylinder 110 and the rotating member 162 are relatively and synchronously rotated.

Upon relative rotation of the cylinder 110 and the rotating member 162, the blades 163 and 164 protrude/-retract in the radial direction of the rotating member 162. In addition, a refrigerant as a fluid to be compressed is supplied into the suction chamber 170 through a suction pipe 173 connected to the sealed case 102, the bore 172 in the main bearing 171, and the suction gas supply path 169. The refrigerant supplied into the suction chamber 170 is transferred in the opposite directions toward delivery chambers 174. This refrigerant is compressed while it is transferred.

In addition, the compressor 161 includes two pairs of blade stoppers 175 and 176 on the suction and delivery sides. The suction-side blade stoppers 175 are constituted by solid columnar members and have stepped portions on their surfaces. The delivery-side blade stoppers 176 are constituted by hollow cylindrical members and have stepped portions on their outer surfaces, similar to the suction-side blade stoppers 175.

The suction-side blade stoppers 175 are located at the suction side, i.e., an intermediate portion, and extend into the suction chamber 170. The suction-side blade stoppers 175 are located near the suction-side end portions of the blades 163 and 164 and extend into suction-side recess portions 177 in the rotating member 162. The suction-side blade stoppers 175 are located inside the rotor 106 of the motor 104 in the radial direction and are covered therewith.

The delivery-side blade stoppers 176 are located at the delivery side, i.e., the two end portions of the cylinder 110, and extend into the delivery chambers 174. The delivery-side blade stoppers 176 are located near the delivery-side end portions of the blades 163 and 164 and extend into delivery-side recess portions 178 in the rotating member 162. The delivery-side blade stoppers 176 are located outside the rotor 106 in the radial direction so as to be spaced apart therefrom. The delivery-side blade stoppers 176 cause the delivery chambers 174 to communicate with the outside of the cylinder 110 through delivery holes 179 as paths for a fluid to be compressed.

When the blade 163 (or 164) is about to move to the suction or delivery side along the groove 165 (or 166), each pair of blade stoppers 175 and 176 stops the blade 163 (or 164) to inhibit its movement.

With the compressor 161 having this structure, the same effects as those obtained by the fourth embodiment can be obtained.

In each embodiment described above, since a compressed refrigerant is temporarily delivered into the sealed case 102, a high pressure is set in the sealed case 102. However, the present invention can be applied to a compressor in which a low pressure is set in a sealed case 102.

In this case, in the compressor designed to compress a refrigerant while transferring it in one direction, as in the fourth embodiment, a suction-side blade stopper is constituted by a hollow member, and a delivery-side blade stopper is constituted by a solid member. In addition, the delivery-side blade stopper is arranged inside a rotor, and the suction-side blade stopper is located outside the rotor.

Furthermore, in the compressor designed to compress a refrigerant while transferring it in two directions, as in the seventh embodiment, a refrigerant is supplied from the two ends toward the middle portion of the cylinder, and delivery-side blade stoppers located at the middle portion are covered with a rotor.

The application of the fluid compressor of the present invention is not limited to a refrigeration cycle. Various changes and modifications can be made within the spirit and scope of the invention.

What is claimed is:

1. A fluid compressor comprising:

a cylinder;

a rotating member eccentrically arranged in said cylinder, said rotating member having a spiral groove formed in an outer surface thereof at a gradually decreasing pitch;

a spiral blade having a suction-side end portion and a delivery-side end portion and fitted in said groove to be retractable;

a plurality of operating chambers formed in said cylinder, partitioned by said blade, and gradually decreasing in volume, and allowing a working fluid to be supplied thereinto;

an Oldham mechanism for coupling said cylinder and said rotating member to each other and rotating said cylinder and said rotating member relative to each other, said Oldham mechanism having a rotating member Oldham portion arranged on said rotating member and having parallel slide contact surfaces;

a lubricant supplied into said cylinder and urged against an inner surface of said cylinder upon rotation of said cylinder; and a lubricant retainer arranged in said cylinder and having a delivery hole for guiding the fluid, supplied into said cylinder, outside said cylinder, said lubricant retainer protruding into said cylinder to regulate a thickness of the lubricant, wherein a protrusion size h of said lubricant retainer into said cylinder is set to satisfy $$h > d/2 - (H/2 - e)$$

where d is an inner diameter of said cylinder, H is a distance between the slide contact surfaces of said rotating member Oldham portion, and e is an eccentricity of said rotating member.

2. A fluid compressor according to claim 1, wherein said Oldham mechanism comprises:

an Oldham ring having engaging grooves in two surfaces thereof, the engaging grooves extending in orthogonal directions, an Oldham ring receiver having projections and fixed to said cylinder, the projections slidably engaged with the engaging grooves in one surface, and a rotating member Oldham portion extending throughout a length of said rotating member in a radial direction thereof and slidably engaged with the engaging grooves in the other surface, said rotating member Oldham portion including a shaft portion of said rotating member.

3. A fluid compressor according to claim 2, wherein said Oldham ring has a C shape.

4. A fluid compressor comprising:

a cylinder;

a bearing member fitted in an end portion of said cylinder;

a rotating member eccentrically arranged in said cylinder and rotatably supported by said bearing member, said rotating member having a spiral groove formed in an outer surface thereof at a gradually decreasing pitch;

a spiral blade having a suction-side end portion and a delivery-side end portion and fitted in said groove to be retractable;

a plurality of operating chambers formed in said cylinder, partitioned by said blade, and gradually decreasing in volume, and allowing a working fluid to be supplied thereinto;

an Oldham mechanism for coupling said cylinder and said rotating member to each other and rotating said cylinder and said rotating member relative to each other, said Oldham mechanism having a rotating member Oldham portion arranged on said rotating member and having parallel slide contact surfaces; and a delivery hole, formed in said bearing member, for discharging the fluid outside said cylinder, said delivery hole having an inlet open to a portion between slide contact surface of said rotating member Oldham portion and a central axis of said cylinder.

5. A fluid compressor comprising:

a cylinder;

a rotating member eccentrically arranged in said cylinder, said rotating member having a spiral groove formed in an outer surface thereof at a gradually decreasing pitch;

a spiral blade having a suction-side end portion and a delivery-side end portion and fitted in said groove so as to be retractable;

a plurality of operating chambers formed in said cylinder, partitioned by said blade, and gradually decreasing in volume, and allowing a working fluid to be supplied thereinto; and an Oldham mechanism for coupling said cylinder and said rotating member to each other and rotating said cylinder and said rotating member relative to each other, said Oldham mechanism comprising:

an Oldham ring having engaging grooves in two surfaces thereof, the engaging grooves extending in orthogonal directions, an Oldham ring receiver having projections and fixed to said cylinder, the projections slidably engaged with the engaging grooves in one surface, and a rotating member Oldham portion extending throughout a length of said rotating member in a radial direction thereof and slidably engaged with the engaging grooves in the other surface, said rotating member Oldham portion having a pair of parallel slide contact surfaces formed thereon to be parallel to an axis of said rotating member, said parallel slide contact surfaces being continuous with a circumferential surface of said rotating member, and said rotating member Oldham portion including a shaft portion of said rotating member.

6. A fluid compressor according to claim 5, wherein said Oldham ring has a round shape.

7. A fluid compressor comprising:

a cylinder;

a rotating member eccentrically arranged in said cylinder, said rotating member having a spiral groove formed in an outer surface thereof at a gradually decreasing pitch;

a spiral blade having a suction-side end portion and a delivery-side end portion and fitted in said groove to be retractable;

a plurality of operating chambers formed in said cylinder, partitioned by said blade, and gradually decreasing in volume, and allowing a working fluid to be supplied thereinto;

a motor having a stator and a rotor, said rotor being fixed to an outer surface of said cylinder, and said motor being designed to rotate said cylinder and said rotating member relative to each other; and suction-side and delivery-side blade stoppers protruding into said cylinder, said blade stoppers being in contact with the suction-side end portion and delivery-side end portions of said blade, one of said blade stoppers having a fluid path formed therein to cause the inside of said cylinder to communicate with the outside thereof so as to allow the fluid to pass therethrough, said blade stopper with the fluid path being located outside said rotor in an axial direction of said rotor, and said blade stopper without the fluid path being located inside said rotor in the axial direction of said rotor, wherein the fluid is compressed while the fluid is transferred.

8. A fluid compressor according to claim 7, further comprising:

a sealed case constituted by a case body and a frame; and a bearing member fixed to said frame.

9. A fluid compressor according to claim 7, further comprising:

a sealed case constituted by a case body and a frame; and a bearing member integrally formed on said frame.

10. A fluid compressor according to claim 7, wherein a plurality of blades, each identical to said blade, are arranged, a plurality of sets of operating chambers are formed, each set of said operating chambers being identical to said operating chambers, a plurality of pairs of suction- and delivery-side blade stoppers are arranged in accordance with the number of said blades, each suction-side blade stopper and each delivery-side blade stopper being identical to said suction- and delivery-side blade stoppers, and the fluid is compressed while the fluid is transferred in a plurality of directions.

11. A fluid compressor according to claim 8, wherein said bearing member has a lubricant path, the lubricant path being open to a circumferential surface of said bearing member.

12. A fluid compressor according to claim 9, wherein said bearing member has a lubricant path, the lubricant path being open to a flat surface of said frame.

* * * * *